United States Patent [19]

Jones

[11] Patent Number: 4,552,220

[45] Date of Patent: Nov. 12, 1985

[54] OIL WELL EVACUATION SYSTEM

[76] Inventor: Brian D. Jones, 1795 Huntington St., Riverside, Calif. 92504

[21] Appl. No.: 576,970

[22] Filed: Feb. 3, 1984

[51] Int. Cl.[4] ..... E21B 43/00

[52] U.S. Cl. ..... 166/369; 166/311; 166/72; 166/176; 198/702; 198/712; 198/713; 37/191 R

[58] Field of Search ..... 166/369, 311, 177, 72, 166/176, 69, 162, 168, 170; 198/702, 713, 714, 494, 518, 643, 710, 712; 37/191 R, 191 A, 192 R, 192 A; 175/89, 90

[56] References Cited

U.S. PATENT DOCUMENTS

| | | | |
|---|---|---|---|
| 55,178 | 5/1866 | Towle | 198/635 |
| 587,124 | 7/1897 | James | 198/643 |
| 762,808 | 6/1904 | Cushing et al. | 166/177 X |
| 769,014 | 8/1904 | Pedley | 198/635 |
| 831,448 | 9/1906 | Leinweber | 198/633 |
| 859,402 | 7/1907 | Middleton | 198/702 |
| 994,487 | 6/1911 | Vaichis et al. | 198/535 |
| 1,007,282 | 10/1911 | Hawley | 198/529 |
| 1,017,847 | 2/1912 | Carl | 198/635 |
| 1,153,416 | 9/1915 | Bemiss et al. | 416/7 |
| 1,230,666 | 6/1917 | Carden | 166/177 X |
| 1,304,033 | 5/1919 | Edmonson | 198/702 X |
| 1,389,428 | 8/1921 | Gartling | 417/320 |
| 1,425,112 | 8/1922 | Long | 198/643 |
| 1,481,735 | 1/1924 | Peck | 198/702 |
| 1,511,506 | 10/1924 | Cortes | 198/637 |
| 1,540,681 | 6/1925 | Detaint | 198/643 |
| 1,703,963 | 3/1929 | Scruby | 198/525 |
| 1,740,821 | 12/1929 | Kneuper | 198/497 |
| 1,763,395 | 6/1930 | Frederick | 198/529 |
| 1,769,336 | 7/1930 | Detaint et al. | 198/702 |
| 1,868,219 | 7/1932 | Parker | 417/320 |
| 2,329,913 | 9/1943 | Kizziar | 198/523 |
| 2,438,298 | 3/1948 | Reed | 198/700 |
| 2,576,992 | 12/1951 | Bainbridge et al. | 414/505 |
| 2,662,486 | 12/1953 | Hillger | 166/177 X |
| 2,704,981 | 3/1955 | Gustafson | 198/525 |
| 3,289,593 | 12/1966 | Corry | 198/702 |
| 3,372,791 | 3/1968 | Kennedy, Jr. | 198/307 |
| 3,774,685 | 11/1973 | Rhodes | 166/369 |

*Primary Examiner*—Stephen J. Novosad
*Assistant Examiner*—William P. Neuder
*Attorney, Agent, or Firm*—Knobbe, Martens, Olson & Bear

[57] ABSTRACT

A system for evacuating sand, paraffin, and other particulate matter from an oil well, while simultaneously lifting the oil to the surface and stimulating its rate of production, comprises a series of transport units attached to an endless belt. The belt is positively driven between a wellhead station at the surface and a downhole module which is self centering within the well casing, thereby avoiding damage and wear to the casing. Preferably, the belt comprises a roller chain which enables the depth and rate of production of the evacuation system to be easily adjusted. The transport units are replaceably mounted on the belt and are specially designed to agitate and accumulate the particulate member in the oil well.

32 Claims, 11 Drawing Figures

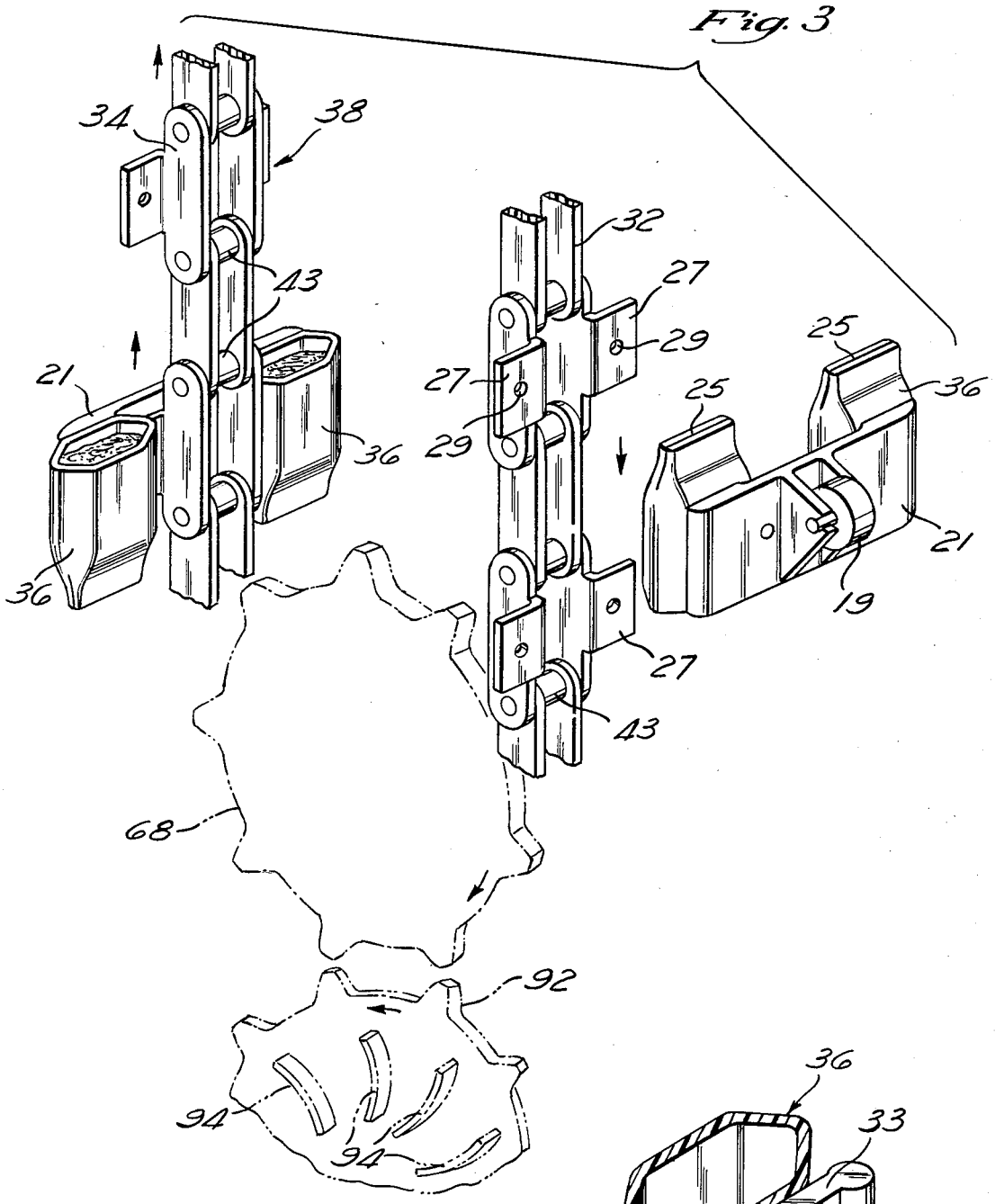
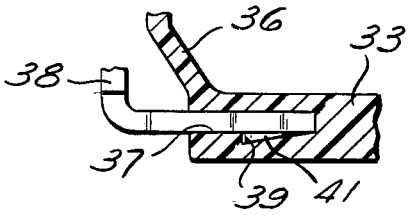
Fig. 8
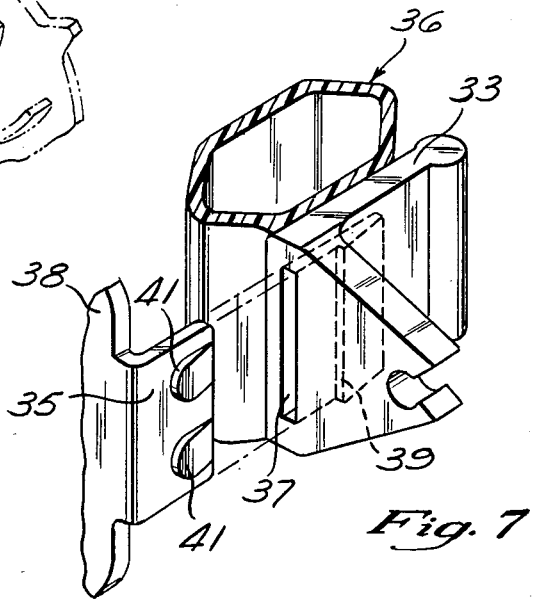
Fig. 7

Fig. 9
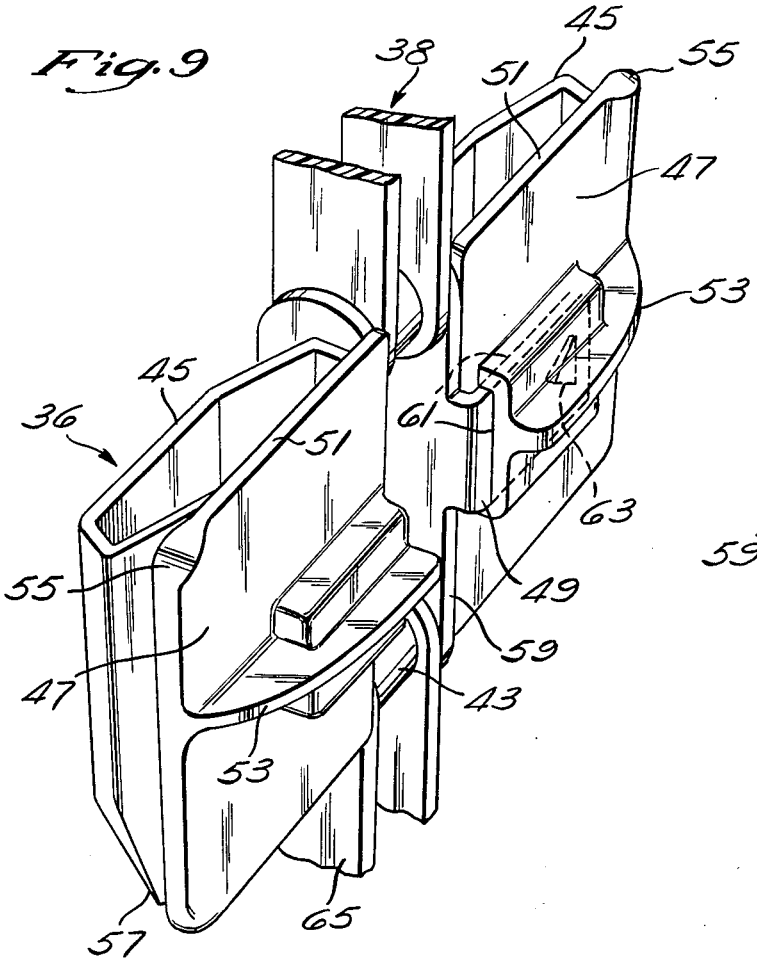
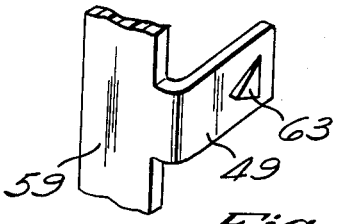
Fig. 10
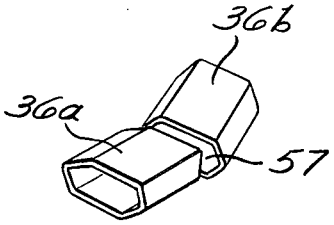
Fig. 11

OIL WELL EVACUATION SYSTEM

BACKGROUND OF THE INVENTION

The present invention relates to a system for evacuating from oil wells sand, paraffin, water and other non-petroleum by-products of oil production, thus enhancing such production, while at the same time efficiently and economically removing the oil from the well.

When the drilling of an oil well is first completed, it is usually expected that the petroleum and other fluid in the well will flow to the surface by the natural reservoir pressure. But in most wells, the natural pressure is not sufficient to "lift" the oil to the surface. For example, of all oil wells recently completed, approximately 90% were placed on "artificial lift" systems which bring the oil to the surface by means other than natural formation pressure. Furthermore, all of the natural lift wells, at sometime during their economic life, will diminish in natural pressure to the point where artificial lift is required to raise the fluid to the surface in order to obtain the maximum recovery of oil to the producer.

Under artificial lift production, a well will eventually reach a point where it experiences relatively low production rates. For example, in Calif., which is one of the leading oil producing states in the country, the average barrel per day production is approximately twenty-two barrels per well. In Tex., this rate is approximately fourteen, while in Okla. the same rate is only approximately five barrels per day per well. Thus, a substantial percentage of the oil produced in the United States comes from marginally producing and extensively depleted oil wells. Therefore, the production of such oil in the most efficient and economic manner is a major objective of the oil well owners or lease holders.

At the same time, extensively depleted oil wells suffer from a number of obstacles which make it difficult to efficiently and economically lift the oil. For example, oil-borne sand and other solid, non-petroleum matter frequently settles in the well bore, thus inhibiting the natural flow oil from the surrounding subterranean formations into the well bore.

Many important oil reservoirs are in sand or a sand-bearing formation. The sand, which is usually an extremely fine material having the consistency of flour, is carried by the oil in the direction of and into the well bore as oil is removed. With conventional oil recovery techniques, production always decreases with time as accumulations of sand are deposited in and around the well bore. Of all oil wells which are capped or closed, a large percentage of the closures are due to a high accumulation of sand in the well, which makes production uneconomical. In order to increase production of the oil well, the sand must be bailed out or otherwise removed from the oil well bore. However, even removal of sand from the bore itself will not restore the well to its original production because of the surrounding accumulations of sand.

By far, the predominant means for accomplishing the artificial lift of oil is the "sucker rod" pumping system. The sucker rod system accounts for approximately 90% of all artificial lift wells in the United States. This system comprises a mechanical pump which is lowered into the well at the bottom of a string of solid, rigid sucker rods, each being approximately 30 feet in length. The sucker rod and pump combination are contained within a tubing which also extends from the bottom of the well to the surface. The sucker rod string is attached to a polished rod at the surface which passes through a stuffing box and is attached to the pumping unit. The pumping unit produces the necessary reciprocating motion to actuate the sucker rods and sub-surface pump. The pumping unit generally comprises a walking beam and a counterweight for counter-balancing the weight of the rods and pump. The walking beam produces an up and down motion on the sucker rods thus pumping the fluid to the surface. In order to install the rods and sub-surface pump, a large tower is required to be placed over the wellhead for the sequential attachment of the long rods to one another. After the pumping system is in place, the tower is removed.

A severe disadvantage of the sucker rod pumping system is that it is unable to remove the sand or other solids from the well. Furthermore, in order to bail the sand, the sucker rod string and tubing must be completely removed from the oil well by the use of a production rig and crew. This process may take from two to three days and is quite expensive. The frequency with which this process is required will determine whether oil can be economically produced from a certain well. In one instance, sand had to be bailed out from a well every two days. If the oil cannot be economically produced, the well is simply capped off.

In order to reduce the sand problem, some oil wells are provided with a gravel pack surrounding the casing at the bottom of the well in order to filter the sand while permitting the crude oil to pass into the casing and be pumped to the surface. However, the sand accumulation often becomes so severe that even this method is not successful. Under such circumstances, the casing of the well must be removed, as well as the complete sucker rod system, at an even greater expense.

Moreover, the crude oil found in some parts of the United States contains a high percentage of paraffin. Another severe disadvantage of the sucker rod pumping system is that paraffin deposits in the tubing and flow lines around the sucker rods are a source of considerable trouble and expense. Again, in order to eliminate these deposits, the entire sucker rod string and tubing must be removed from the well.

Another disadvantage of the sucker rod system is that the contact by the tubing and sucker rods against the casing of the oil well can cause it to deteriorate. This is particularly a problem in "dogleg" wells in which the bore deviates from the vertical at some point by a significant amount. Such bends in the well bore are quite common and, for example, permit an on-shore well to tap an off-shore deposit. If a hole in the casing is formed then the production of the well must be discontinued while it is repaired at great inconvenience and expense, otherwise the oil will contaminate the surrounding formation which may include fresh water. Furthermore, with a hole in the casing other stimulation methods, such as steam injection, cannot be utilized.

The configuration of the sucker rod system, including its string of attached solid rods, and the requirement of a tower for installation and removal greatly complicates and makes uneconomical the use of such a system in marginally producing wells. Furthermore, the cost of the system can easily amount to $100,000, and over 50% of the sucker rod pumping systems in the United States experience some sort of failure each year.

SUMMARY OF THE INVENTION

The present invention solves the problems associated with the artificial lift of oil in marginally producing wells by providing a system for economically evacuating sand, paraffin and other non-desirable solid by-products while at the same time efficiently lifting the oil to the surface. These by-products, together with the oil, are continually lifted to the surface and evacuated out of the well bore, in order to enhance the natural flow of oil into the bore and increase the production rate. Furthermore, where sand is a major problem, the present system is provided with means for agitating and excavating the sand in order to evacuate it. By continually removing the oil-borne sand, the amount of sand in the formation surrounding the box is actually reduced over time. One may visualize an ever-enlarging hole surrounding the well bore, into which oil can flow with ever-decreasing resistance.

In addition to increased production, the time between oil well maintenance procedures is reduced to a minimum. Moreover, the time required to effect such procedures is vastly reduced because the system of the present invention can be quickly and easily removed and lowered again into the well bore, thus avoiding the time delay and expense associated with sucker rod pumping systems.

The evacuation system of the present invention is comprised of a series of transport units which are individually and replaceably attached to an endless belt. The belt travels in a loop down into the well bore, collects the by-products and oil and returns to the surface, bringing with it the transport units containing the solids and oil. The belt travels between a downhole module which is located in the bottom of the well and a wellhead station, which serves to drive the endless belt in its continuous loop.

The endless belt is flexible such that it can be lowered into the well and returned again without need for an expensive installation rig as required with the sucker rod pumping system. In addition, the flexibility of the endless belt provides for ease in depth adjustment by simply breaking the belt, adding length to increase the depth or taking away length to decrease the depth at which production is taking place. Additionally, the production rate of the endless belt can easily be increased, much more easily as compared to the sucker rod system, by simply increasing the rate at which the belt is driven through its continuous loop. Moreover, since the endless belt is positively driven about its loop, it can be centered in the casing and avoid contact therewith, thus reducing wear and destruction of the casing. In a preferred embodiment, the belt may also carry means to prevent the belt, and even the transport units, from contacting the casing. Casing wear and transport unit wear may thus be avoided, even in dogleg wells. Therefore, the present evacuation system, with its endless belt, overcomes the problems associated with previous sucker rod pumping system, particularly in marginally producing wells.

The endless belt preferably is comprised of a roller chain which is driven on sprockets and attached to the wellhead station and the downhole module. The roller chain is strong enough to withstand the forces exerted on it during oil production, and yet light enough to efficiently carry the oil to the surface. The rollers reduce wear and abrasion on the system and the chain itself.

The transport units which are attached to the endless belt are specially designed to promote agitation and excavation of the sand or other solid by-product materials in the well bore. They are capable of lifting both solids and oil continuously and simultaneously as they are transported by the endless belt. In a preferred embodiment, the transport units are also provided with a scraping blade specially designed to remove paraffin deposits which may have built up on the interior surface of the oil well casing. The scraping blade and the transport unit itself prevent contact between the chain and the casing. The transport units, including the scraping blade, are manufactured from an elastomeric material which protects the surface of the casing. In an alternative embodiment, the chain carries an elastomeric spacer to prevent the transport unit from contacting the casing. Furthermore, the special design of these units permits them to be quickly and completely evacuated of the materials contained therein by means of a self-closing hinged valve. Moreover, the design of the transport units permit them to partially nest one inside the other as they turn the tight corner at the bottom of the well around the downhole module.

The downhole module leads and guides the present system into the well and is provided with means for agitating and excavating the sand or other by-products located therein. Preferably, such agitation means comprises a sprocket driven by the roller chain of the endless belt which is provided with curved turbine blades for pulling the downhole module toward the bottom of the well and thereby agitating and excavating materials below the downhole module. The agitation means may also serve to prevent the endless belt from becoming detached from the downhole module. The downhole module may also be provided with a first roller for evacuating air from the transport units prior to their being filled, and also a second roller for assisting the guidance for the endless belt and transport units on their return trip to the surface. As with the other components of the present evacuation system, the downhole module is designed to minimize wear and abrasion on the interior surface of the well casing. The module can also be provided with instrumentation which will permit the topside monitoring of temperature, pressure, oil/water interface level, etc. during the evacuation process.

The wellhead station provides a circuit over which the endless belt travels as the oil, sand and other solids or liquids are removed from the transport units and collected. Furthermore, the wellhead station provides means for adjusting the depth at which production is taking place and also the width or distance separating the two oppositely traveling portions of the endless belt. This width adjustment, called the "throat" adjustment, takes place at the well head and permits the scraper blades on the transport units to efficiently remove paraffin deposits from the interior surface of the casing.

The wellhead station is a compact unit that can be easily mounted on a vehicle so as to be transported from one well to another. Furthermore, unlike the sucker rod system, the construction and configuration of the wellhead station, including the endless belt and downhole module, greatly facilitate the lowering and raising of the evacuation system so that it can be quickly and inexpensively accomplished in order to perform any maintenance required on the well.

The present invention also comprises a method of evacuating oil wells, including the steps of introducing an endless belt into an oil well having transport containers attached to the endless belt, biasing the belt or excavation means driven by the belt against the sand or particulate matter at the bottom of the well, agitating and excavating the particulate matter and accumulating said matter in the transport containers, lifting the endless belt with the transport containers to the surface, removing the particulate matter and oil from the containers, and continuing to circulate the endless belt in the same fashion.

Another method of the present invention relates to the introduction of the endless belt and downhole module into the well. The steps of this method include bringing a spool containing a belt adjacent to the well, securing one end of the belt to prevent it from entering the well, attaching the weighted downhole module to the belt between the secured end of the belt and the spool, introducing the endless belt and the downhole module into the well casing, and feeding the belt into the well by rotating the spool whereby the downhole module rolls down the belt and carries a loop of the belt into the well. This method is simply reversed for removing the evacuation system from the well.

A similar method for adjusting the depth of the evacuation system includes the steps of engaging a brake against the endless belt at the top of the well casing, breaking the endless belt, attaching to one broken end of the belt the end of a length of belt contained on a spool adjacent the well, winding the spool so as to add additional length down the well to increase the depth of the evacuation system or winding the spool in an opposite direction so as to take up length of the endless belt from the well and to wind it onto the spool, thus decreasing the depth of the evacuation system, until the desired depth is achieved, once again breaking the belt and reattaching it to the portion against which the brake is engaged, and disengaging the brake to permit the circuit of the endless belt to continue.

BRIEF DESCRIPTION OF THE DRAWINGS

FIG. 3 is an exploded, perspective view, similar to FIG. 2, illustrating the attachment of the transport units to the roller chain, and also illustrating a second sprocket for maintaining the roller chain in contact with the downhole module, the second sprocket having turbine-like blades for agitation and excavation of particulate matter in the wells;

FIG. 7 is a partial perspective view illustrating means for attaching the transport units to the endless belt;

FIG. 8 is a cross-sectional view also illustrating one method in which the transport units are attached to the endless belt;

FIG. 9 is a perspective view illustrating in detail the transport unit of the present invention;

FIG. 10 is a perspective view illustrating another method of attaching the transport unit to the roller chain of the endless belt; and FIG. 11 is a perspective view illustrating the nesting of the transport units as they turn the corner at the bottom of the well.

DETAILED DESCRIPTION OF THE INVENTION

Figure 1:
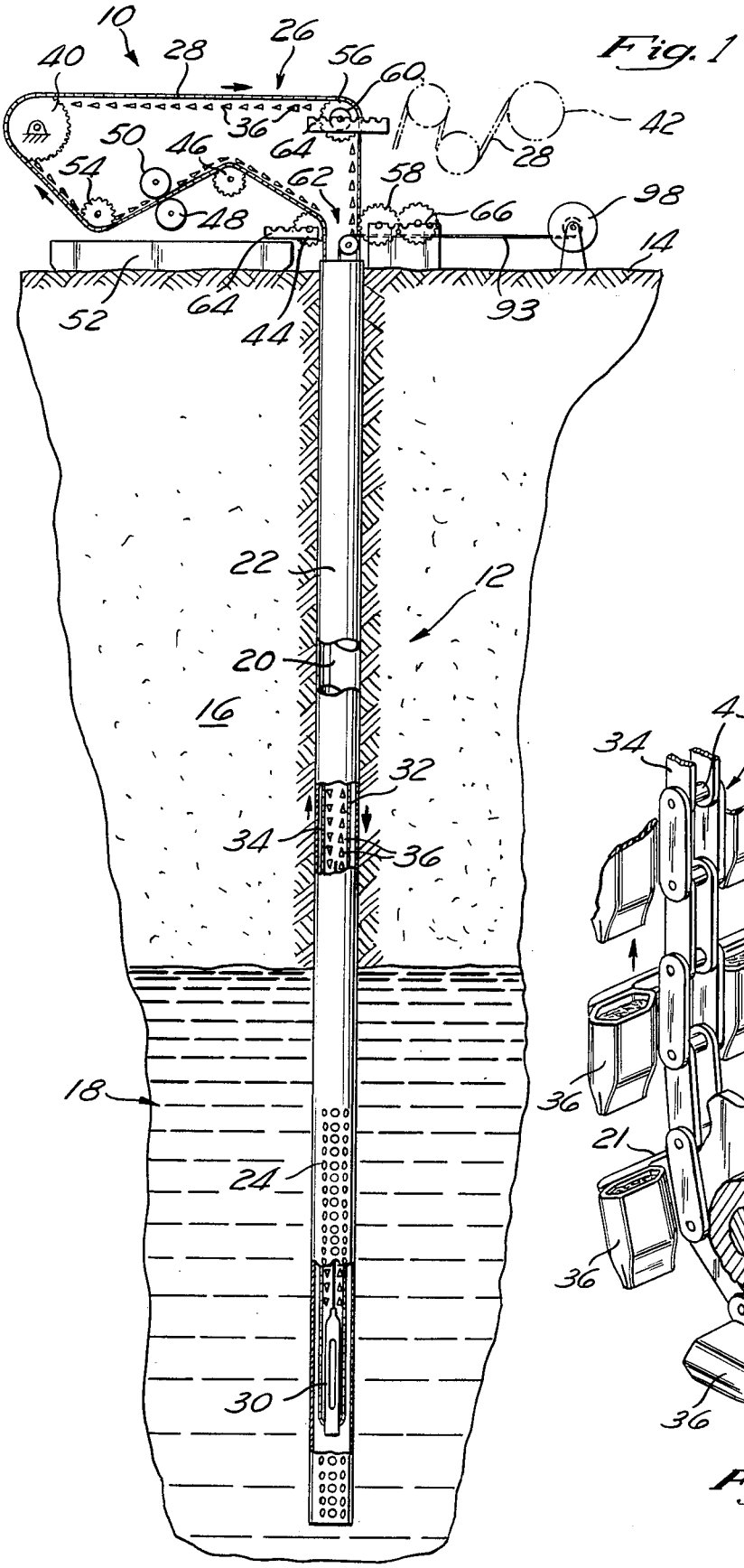
FIG. 1 is an overall, perspective view of the evacuation system of the present invention as installed in a well, illustrating the wellhead station, the endless belt with the attached transport units, and the downhole module around which the endless belt travels before its return trip to the surface.

FIG. 1 illustrates schematically the overall evacuation system 10 of the present invention as installed in an oil well 12. The well extends from the surface 14 of the ground down through the subterranean formation 16 and into the oil-bearing formation 18 within the earth. The oil well bore 20 is lined with a metal, or sometimes a concrete casing 22 which is perforated 24 at its lower portions in order to permit the flow of oil into the interior of the casing 22. It is through these perforations 24 that oil-borne sand accumulates in the casing thus inhibiting the natural flow of oil into the well bore and reducing the production rate of the well. In addition, the paraffin contained in the crude oil accumulates on the inside of the casing thus making production difficult through other artificial lift methods, such as the sucker rod pump system.

FIG. 1 illustrates the components of the evacuation system 10 of the present invention, including the wellhead station 26 located at the top or head of the oil well 12, the endless belt 28 traveling through the wellhead station 26 down into the well bore (the "downside" 32) and up again (the "upside" 34) to the surface, and the downhole module 30 located at the bottom of the well bore around which the endless belt 28 turns. The endless belt 28 is provided with transport units 36 schematically shown in FIG. 1. These units are, preferably, containers which are inverted on the downside 32 of the endless belt 28 but are then right side up on the upside 34, so that they can be filled with fluids and solids on their return trip to the surface, thus evacuating the well bore 20.

Figure 2:
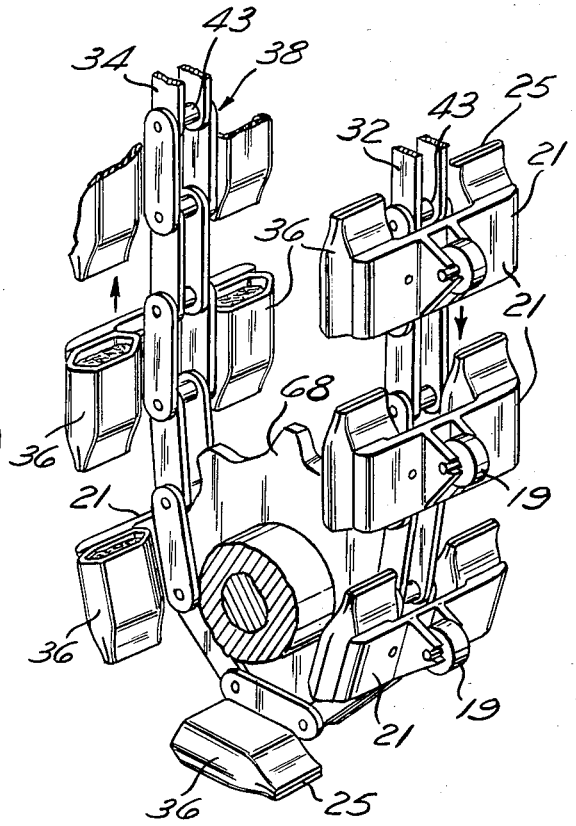
FIG. 2 is a closeup perspective view of the endless belt, in this case a roller chain, with attached transport units, showing the chain as it travels around a sprocket located on the downhole module.

Preferably, the endless belt 28 is comprised of a roller chain 38, as shown in FIG. 2, which is driven through a series of sprockets located in the wellhead station 26, including a primary drive sprocket. The evacuation system 10 of the present invention, utilizing a number 40 roller chain 38, double pitch, has been successfully operated in a well having a depth of approximately 1200 feet, which is an average well depth. The system can be operated at a production rate of 100–400 feet per minute. At 100 feet per minute, the present invention will produce 100 barrels of crude oil per day at a 60% efficiency, meaning that the transport units 36 are only 60% full. Moreover, the initial set up of the evacuation system 10, in one test, took only four and one half hours, as compared to two to three days for a conventional sucker rod tower set up. That test involved individually joining and manually lowering 24 lengths of chain, each 100 feet long. It can be appreciated that the set-up time would be significantly reduced by feeding the chain into the well from a spool. In addition, the present invention can operate in wells of 4,000 feet in depth. The cost of the present evacuation system 10 is much less than the conventional sucker rod system, making it ideal for utilization on marginally producing wells.

Furthermore, in addition to economical oil production, the use of the transport units 36 makes the evacuation system 10 readily capable of excavating sand and other particulate matter which may be located in the well casing and removing it, so as to stimulate production in the well. Production is further enhanced by removal of sand from the surrounding formation. Also, any water which may exist in the oil bearing formation 18 is also carried to the surface so as to not slow the oil production rate of the well. Simultaneously, the crude oil is also lifted to the surface efficiently and economically. Thus, unlike previous artificial lift methods, there is no need to interrupt production in order to remove the sand from the casing. Furthermore, as noted above, if maintenance of the well is required, the evacuation system 10 can be quickly removed from the well and replaced. The present system is sufficiently compact and light-weighted such that it, preferably, is mounted on a vehicle for transport from one well to another. With such mobile mounting, including a supply spool for the endless belt 28, the present system can be set up for production within approximately one-half hour.

Referring to FIG. 1, the evacuation system 10 can be lowered into the well in accordance with the following steps. A spool 42 containing the endless belt 28 is brought to a well, preferably on a vehicle (not shown). One end of the belt is threaded through the sprockets of the wellhead station 26 and attached securely to an object on the surface, such as a brake (not shown). Alternately, the brake is located on the axle of the drive motor (not shown) so that the drive sprocket (40) serves as a stationary object to which the belt (28) is attached. The weighted downhole module 30 is attached to the belt between the secured end and the supply spool 42. The belt and module are then lowered into the well casing and a sufficient length of the belt is fed into the well by rotating the spool 42, whereby the downhole module 30 rolls down the endless belt 28 carrying a loop of belt with it into the well. Once the module is at the desired depth, the endless belt 28 is severed from the remaining supply on the spool 42 and is attached to the secured end of the belt on the wellhead station 26. Operation of the evacuation system 10 can then proceed. In order to remove the system from the well, these steps are simply reversed.

In preferred embodiments, the belt is lowered at least 200, and preferably 400 or 600 feet into the well. The spool 42 preferably contains at least 600 feet of belt, and most preferably at least 800 or 1,200 feet. If the length of chain carried on one spool is insufficient, multiple spools may be provided.

In order to adjust the depth of the downhole module 30, the endless belt 28 is once again attached securely to an object at the wellhead station 26 and the broken end is attached to the end of the supply belt mounted on the spool 42. The spool 42 can then be rotated in order to either increase the length of the belt onto the system or take up length from the system and wind it onto the spool 42. During this process, it is desirable to reverse the drive sprocket so as to provide slack in the endless belt 28 in order to facilitate the addition or deletion of endless belt 28 length. Once the desired depth is accomplished, the endless belt 28 is once again severed from that contained on the supply spool 42 and is reattached to the opposite end secured at the wellhead. After the brake is removed, production can continue.

FIG. 1 illustrates the components of the wellhead station 26. The station is comprised of a series of rollers or guides over which the endless belt 28 of the evacuation system 10 passes. When the endless belt 28 takes the form of a roller chain 38, these guides of the wellhead station 26 are sprockets having teeth which engage the roller chain 38 to provide a positive drive mechanism for powering the evacuation system 10. The direction of rotation of the roller chain 38 is indicated by the arrows in FIG. 1.

As the upside chain rises from the well casing 22, it passes over a first sprocket 44 and then turns a slight angle so that the contents of the transport units 36 attached to the chain can begin to flow out of the transport units 36 by the force of gravity. The chain then turns a sharp angle around a second sprocket 46 so that the transport units 36 are virtually inverted, thus further emptying their contents. The chain then passes over a third sprocket and between a pair of squeeze rollers (48 & 50) which press against the transport units 36 and causes them to eject their contents through a valve, which will be described in more detail in connection with FIG. 6.

This series of sprockets and rollers serve to eject the contents of the transport unit so that they may collected in a collection device 52, located beneath the wellhead station 26. The roller chain 38 then passes under a fourth sprocket 54 and over the main drive sprocket 40 along its path to a return sprocket 56. During this path, any drippings from the transport units 36 will again be collected by the collection device 52 under the wellhead station 26. After the chain 38 passes over the return sprocket 56, it is guided by a lower sprocket 58 where it once again reenters the well casing 22 in the downside 32.

The brake is designed both to hold and lock the chain 38 for length adjustment, insertion, and removal, and also to catch the chain 38 in the event of accidental breakage. Any conventional brake, such as a torque or rotation-speed actuated mechanism, may be used by incorporating such a brake into one or more of the sprockets of the wellhead station 26.

In order to enhance the evacuation of the contents of the transport units 36, the return sprocket 56 may be provided with an oversized hub 60 which contacts each transport unit 36 as the roller chain 38 passes over it, thereby causing the chain 38 to bounce in order the jar the contents out of the unit.

The wellhead station 26 is also provided with a novel throat adjustment system 62 for adjusting the distance between the downside 32 and upside 34 portions of the endless belt 28. The diameter of the well casing 22 may vary from five to nine inches. Accordingly, in order to remove the paraffin deposits from the interior surface of the casing by means of the transport unit scraper blades, described in more detail below and illustrated in FIG. 9, this throat adjustment system 62 permits the endless belt 28 to be adjusted in accordance with the throat diameter of the well casing 22. This is accomplished by mounting the first and return sprockets, 44 and 56, respectively, on an adjustable rack 64 wherein the axis of each sprocket 44 & 56 can be adjusted in accordance with a series of holes, mounted on the wellhead station 26. Similarly, the axis of the guide sprocket 58 can also be adjusted by means of a series of slots 66.

Figure 4:
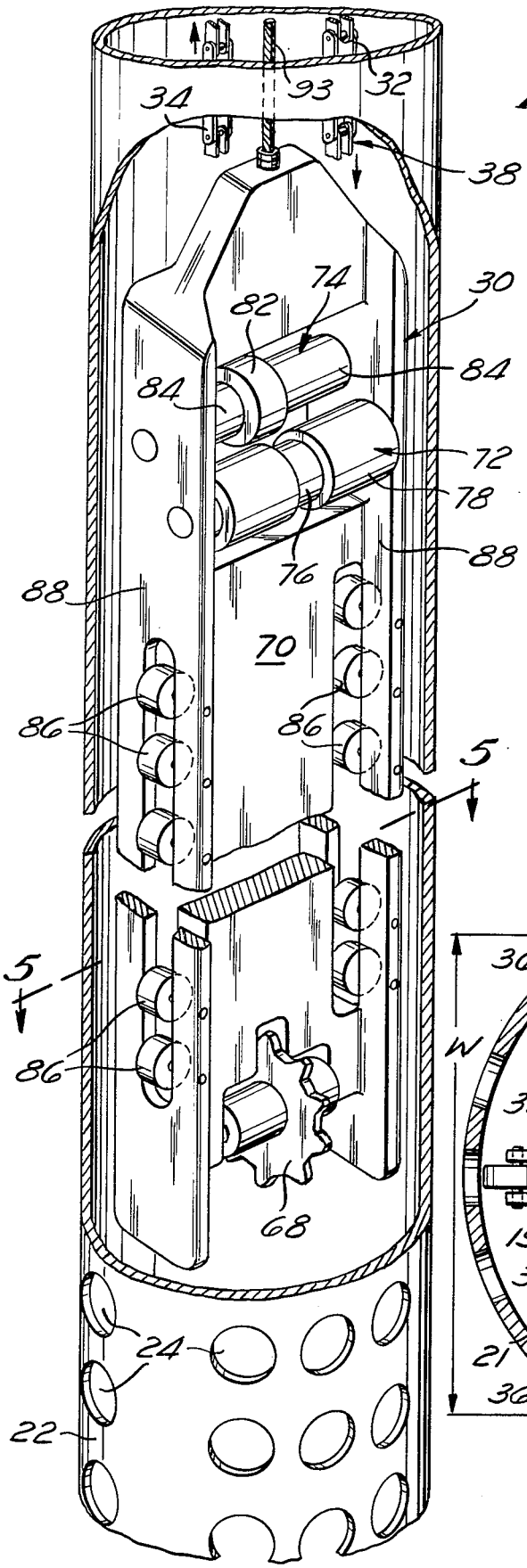
FIG. 4 is a perspective view of the well casing which is cut away to reveal the downhole module.

FIG. 4 illustrates the downhole module 30 of the present evacuation system 10, and portions are also illustrated in FIGS. 2–3 and 5–6. FIG. 4 illustrates the downhole module 30 as positioned within the perforated casing 22 of the oil well. The downside 32 and upside 34 portions of the roller chain 38 are only partially shown in order to reveal the detail construction of the downhole module 30. The module is weighted so that it will penetrate the solid material in the well and reach the desired depth, taking the roller chain 38 or other endless belt 28 configuration with it without the need for additional weights or downhole means. The configuration of the downhole module 30 is generally of an I-beam construction, as best shown in the cross-sectional view of FIG. 5, including a web 70 separating a pair of flanges 88. A turnaround sprocket 68 is mounted near the bottom of the module 30 having its axis parallel to the web 70 of the module.

Also mounted near the upper portion of the module are two rollers, an air evacuator roller 72 and a guidance roller 74. The air evacuation roller 72 is generally cylindrical in shape except for a cutout portion 76 of reduced diameter in the central area. This reduced diameter portion 76 permits the passage of the endless belt 28 while the larger diameter portions 78 on either side engage the transport units 36 (which are inverted on their downward travel) and squeezes them in order to evacuate the air therefrom.

Figure 6:
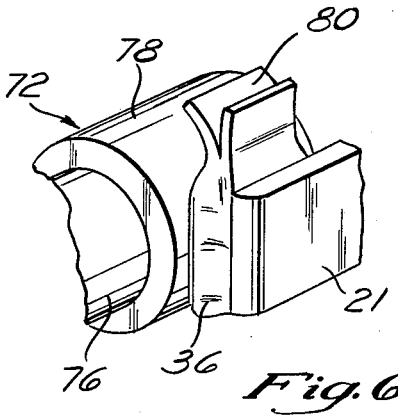
FIG. 6 is a partial perspective view illustrating the manner in which air in the transport units is evacuated through the hinged valve.

This process is illustrated in more detail in FIG. 6, which shows the air evacuation roller 72 engaging a transport unit 36 and causing its valve 80 to open, thus permitting the air inside, or any other substance, to be purged so that the transport unit 36 can be completely filled during its return trip to the surface.

The guidance roller 74 of the downhole module 30 is constructed in a reverse fashion from the air evacuation roller 72. It is provided with a central portion 82 of enlarged diameter, over which the roller chain 38 of the endless belt 28 passes. The reduced diameter portions 84 on either side provide guidance to the transport units 36 on their return trip.

Figure 5:
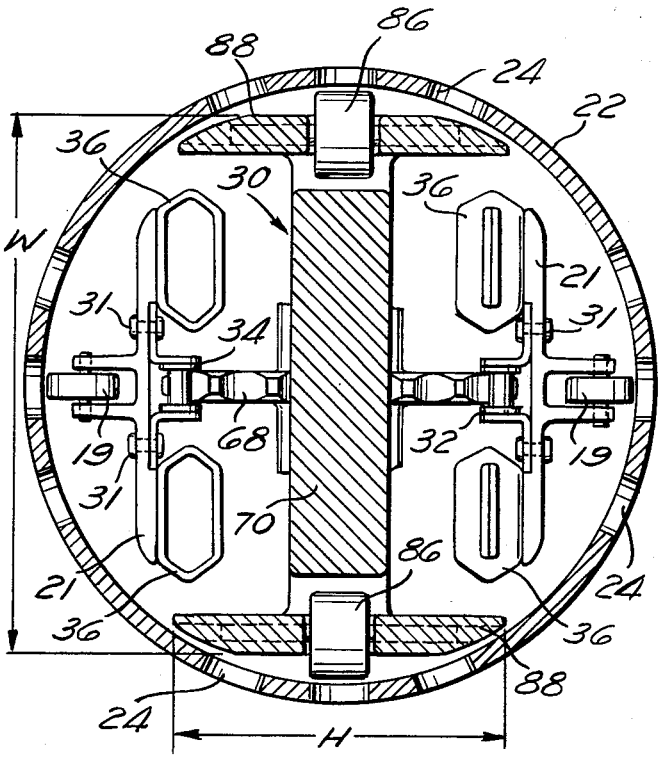
FIG. 5 is a cross-sectional, top plan view of the well casing taken along line 5—5 of FIG. 4 illustrating the downhole module and the location of the endless belt and transport units with respect thereto.

The width W of the downhole module 30 is slightly less than the diameter of the casing 22, as shown in FIG. 5, so that the module does not contact or cause wear on the interior surface of the casing. At the same time, the secure positioning of the module within the casing provides a means for guiding and self-centering the evacuation system 10 and avoids undue contact by the endless belt 28 with the casing. Modules of varying widths W can be mounted on the endless belt to conform to varying well bore diameter. That is, because the roller chain 38 of the endless belt 28 positively engages the turnaround sprocket 68, as well as the other sprockets, including the drive sprocket on the wellhead station 26, the positioning of the downhole module 30 prevents the chain 38 and transport units 36 from undue lateral motion which would contact and wear out the casing. Nevertheless, in the event that the downhole module 30 contacts the side of the casing, it is provided with a vertically mounted series of rollers 86 mounted on the flange 88 on either side in order to reduce frictional wear against the casing.

The downhole module 30 is also uniquely designed in order to agitate and promote the excavation of sand or other particulate matter which may have accumulated in the casing. The flanges 88 extend lower than the turnaround sprocket 68, as shown in FIG. 4, and also have a greater heighth dimension H, as shown in FIG. 5. Thus, the lower portions of the flanges precede the downhole module 30 and stir up the contents of the casing. The rotation of the sprocket 68 itself also serves to agitate the sand in the casing so that the transport units 36 can easily carry it to the surface.

In one embodiment, the transport units 36 themselves contact and excavate the sand on which the downhole module 30 sits. Excavation means instead of or in addition to the transport units 36 themselves may be carried by the chain.

In another embodiment of the downhole module 30, illustrated in FIG. 3, a second, generally spherical, sprocket 92 (schematically shown) is, mounted below the turnaround sprocket 68, and greatly enhances the ability of the downhole module 30 to agitate the sand and actually bore or dig its way through. This lower sprocket (92) also serves the purpose of locking the roller chain 38 onto the turnaround sprocket 68 so that the chain cannot come off of the sprocket, resulting in loss of the module. Moreover, the lower sprocket 92 is provided with curved paddles or turbine-type blades 94 which actually pull the module 30 through the sand and oil down to the desired depth in the well. Because of the compound curvature of these turbine blades 94, this second sprocket 92 is generally spherical in shape. This digging or excavation process is enhanced by the weight of the module 30, which also permits it to serve as a downhole anchor for the evacuation system 10.

Where removal of particulate matter is not a primary consideration, a weighted or instrumented portion of the downhole module 30 may extend below the turnaround sprocket and the belt could pass through the downhole module 30. This would eliminate the need for a means to lock the chain to the turnaround sprocket 68.

An important feature of the downhole module 30 is that it provides for a distinct area within the casing for channeling the rising air bubbles, (the air being evacuated from the transport units 36 on the downside 32), separated from the upside 34 area in which oil is captured by the units. That is, the air is evacuated from the transport units 36, as shown in FIG. 6, will rise through the oil and water found in the casing on one distinct side of the casing, thus leaving the opposite side of the casing non-turbulent so that the transport units 36 can easily be filled to the maximum capacity. The turbulence of the evacuated air, if it were on the oil collection side of the casing, could cause a less than efficient capture of the oil.

Furthermore, the downhole unit 30 may be attached by a safety string 93 which is, in turn, connected to a spool 98 at the surface, as shown in FIG. 1. The safety string 93 may advantageously be a metal cable. Moreover, instrumentation (not shown) can be connected to the downhole module 30 in order to monitor the well bore conditions, such as temperature, pressure, and the level of the oil-water interface. Although the downhole module 30 may be suspended to some extent by the safety string 93, it is preferred that the chain 38 at least partially supports the downhole module 30 to keep tension on the chain and provide positive engagement between the chain 38 and the turnaround sprocket 68.

A number of endless belt embodiments can be successfully utilized in the evacuation system of the present invention. One such embodiment is shown in FIGS. 2 and 3, which illustrates a roller chain 38 having attached to it at every other link a lateral flight 21. Attached, in turn, to the flight are a pair of transport units 36 with an elongate valve 25, shown in the open position in FIG. 6. FIG. 2 illustrates the endless roller chain 38 passing around the turnaround sprocket 68 of the downhole module 30, while in FIG. 3 that sprocket 68 is shown in phantom. FIG. 3 also illustrates the manner of attaching the flights 21 to the roller chain 38. The link of the chain is provided with a pair of oppositely extending flanges 27, each having a hole 29 which mates with a pair of holes in the flight 21. The flight 21 is then attached to the flanges 27 by means of a rivet or screw or other suitable fastener 31, as illustrated in FIG. 5. In an alternate embodiment, the flights are also provided with a roller 19 so that if contact with the interior surface of the casing occurs (FIG. 5), wear or abrasion is minimized.

An alternate embodiment of the flight/transport unit combination is shown in FIGS. 7 and 8. In this embodiment, the flight 33 is integral with the transport unit 36 and is attached directly to the flange 35 of the roller chain 38. The flight 33 is provided with an elongate opening or slot 37 having an interior lip 39 surface which engages a pair of tabs 41 formed on the exterior surface of the roller chain flange 35. Thus, when the slot 37 on the flight 33 is pressed over the flange 35, as shown in FIG. 8, the tabs 41 lock into place against the lip surface 39 of the slot in order to hold the flight 33 and transport unit 36 in place.

One significant advantage of the evacuation system 10 of the present invention is that the transport units 36 are replaceable. Preferably, they are molded from an elastomeric material or an organic polymer which can be forcibly or otherwise destructively removed from the roller chain flanges 35 and disposed of. Alternately, the transport units and endless belt could be integrally molded from plastic. Suitable materials for forming the transport units 36 and flights include polyvinylchloride, linear high-density polyethylene, nylon, delrin, arcylonitrile-butadiene-styrene copolymer, polystyrene, polybutadiene, neoprene, and other engineering plastics and elastomers. Strong, durable materials such as ABS or fiber-reinforced plastics or resins may be advantageously used where strength is a consideration, as in the flights. High rubber or plasticizer content polymers, copolymers, or blends are more suitable for the transport units 36, where flexibility and resilience are desired properties. As any person skilled in engineering plastics will recognize, such additional desirable properties as abrasion resistance, self-lubrication, and oil, temperature, and acid resistance may be readily provided by selecting from among the myriad commercially available materials.

Preferably, the roller chain 38, which is one embodiment of the endless belt 28 of the present excavation system 10, is a number 80 roller chain 38 having a weight of about 1.71 pounds per foot. Such a chain is durable, avoids any kinking problems, and adds increased weight for penetration of heavier materials in the well. Alternately, a number 40 double pitched roller chain is utilized, or a duplex or side-by-side chain, also in order to prevent kinks and provide increased weight-to-length ratios for deeper penetration. The rollers 43 on the chain 38 (FIG. 2) advantageously avoid wear on the sprockets and chain itself.

Another configuration of the transport unit 36 of the present invention is illustrated in FIG. 9. In this embodiment, the transport unit comprises generally a six-sided container 45, with one side serving as a flight 47 for attachment purposes to the flange 49 of the roller chain 38. The flight 47 is also oversized so that one edge 51 extends above the top of the transport unit 36. This edge 51, which is a leading edge on the downside travel of the chain 38, also serves to agitate and excavate the sand that may be accumulated in the oil well casing 22. Midway down on the back of the flight 47 is located a scraper blade 53 for the same purpose, i.e., agitation and excavation. In addition, this blade 53 is curved so as to approximate the radius of the casing 22.

By means of the throat adjustment system 62 of the wellhead station 26, shown in FIG. 1, the distance separating the upside 34 and downside 32 portions of the roller chain 38 can be adjusted so that these flight blades 53 scrape along the interior surface of the casing 22 in order to remove paraffin deposits and other debris or particulate matter which have accumulated in the casing.

The flights 47 and the integral transport unit 36 may be injection molded from an elastomeric material so as to reduce the friction and abrasion of the flight blades 53 against the interior surface of the casing. Furthermore, the upper edge 51 of the flight 47 is provided with a pair of shoulders at the opposite corners. These shoulders comprise wear pads 55 which may engage the casing and are, therefore, reinforced so that the transport unit is not deteriorated by the friction against the casing. At the same time the casing is protected against damage.

The lower portion of the transport unit is provided with a valve 57 which permits the evacuation of air, sand, oil and other solids and fluids. The valve 57 is constructed such that the natural rigidity of the material keeps the valve closed under normal operating conditions, particularly in the production of the heavy or viscous crude oil such as that found in Calif. The valve 57 is actuated by peristaltic action; that is, as a roller or other solid body contacts the transport unit, it forces the contents toward the valve in successive waves, which pressure is sufficient to force the valve open, as exemplified in FIG. 6.

One unique feature of the transport unit 36 is that sand and/or other particulate matter is easily and efficiently evacuated from the unit by the squeeze rollers 48 & 50 of the wellhead station 26. This is because the sand typically will settle to the bottom of the transport unit while the oil or other fluid will rise to the top. Thus, when the squeeze rollers 48 & 50 of the wellhead station 26, shown in FIG. 1, engage the transport unit 36, the fluid in the unit will force the sand and particulate matter out of the unit, thus rinsing it. In other words, no special evacuation means is necessary for the solid matter collected in the transport units 36.

FIGS. 9 and 10 illustrate the manner in which the transport unit 36 is attached to the flange 49 of the roller chain 38. As shown, the flange 49 is preferably an integral portion of the pin link 59 of the roller chain 38 and is inserted into a slot 61 on the flight 47 of the transport unit 36. The flange 49 is also provided with a plurality of pointed tabs 63, one of which is shown in FIG. 10, which engage the interior surface of the slot 61 on the flight 47. The angle of these tabs 63 is such that they resist the opposite or removal motion of the flight 47, with the point of the tab 63 engaging and digging into the interior surface of the slot 61 and holding the flight 47 securely in place, without need for other engagement means. The transport unit 36 is such that it covers one-half of the connecting link 65, both above and below the pin link 59 to which it is attached. Thus, a maximum number of transport units 36 can be attached to the roller chain 38. Furthermore, the back side of the units form a substantially continuous surface in order to make uniform contact with the casing wall, and also protect the roller chain 38 from wear and fouling.

Another unique feature of the transport unit 36 of the embodiment of FIG. 9 is that a maximum number of units can be attached to the chain, and yet the chain 38 can efficiently turn the corner at the turnaround sprocket 68 on the downhole module 30 without having the transport units 36 collide into one another. As shown in FIG. 11, the valve 57 of the leading transport unit 36*a* nests inside the opening of the trailing transport unit 36*b* as the corner is turned. The sloping configuration of the transport unit opening, together with the sloped configuration of the valve 57, provide for this partial nesting.

Another unique feature of the present design is that the belt itself is positively driven, and yet the drive means does not engage the less-durable transport units 36. This feature ensures the longevity of the transport units 36 while permitting high operating speeds.

In summary, the components of the evacuation system 10 of the present invention cooperate in order to efficiently and economically evacuate the contents of an oil well, including sand and other solid deposits as well as the oil and other fluids. The present invention provides lower manufacturing cost, lower operating cost and lower installation and maintenance cost than previous artificial lift methods.

1. A system for enhancing the producing of oil from an oil well by evacuating sand, paraffin and other solid matter therefrom, said well having a well bore surrounded by a well casing, the system comprising:

a station located at the wellhead for receiving and collecting said solids as well as oil produced from said well;

a downhole unit located inside said well casing near the bottom of said well to provide an anchor for said system;

an endless belt substantially supporting the weight of said downhole unit at a predetermined depth in said well, said downhole unit located substantially inside said belt, said belt being driven between said station and said downhole unit;

containers on said belt for simultaneously evacuating from said well said solids and said oil, thereby enhancing the production of said oil; and means comprising enlarged shoulders carried by said belt for preventing said belt from contacting said well.

2. The evacuation system of claim 1, further comprising means on said evacuation means for agitating said solids in order to facilitate their accumulation and evacuation.

3. The evacuation system of claim 1 wherein the depth of said downhole unit can be adjusted by adjusting the length of said endless belt.

4. The evacuation system of claim 1 wherein the downhole unit is inserted into said well and removed therefrom by means of said endless belt.

5. The evacuation system of claim 1, further comprising means for positively locating said evacuation system within said well casing in order to avoid damage and wear to said casing.

6. The evacuation system of claim 5 wherein said positive location means comprises rollers on said downhole unit for substantially centering said downhole unit within said casing.

7. The evacuation system of claim 1 further comprising means located at said station for adjusting the distance separating that portion of said endless belt going into said well from that portion of said endless belt coming out of said well.

8. The evacuation system of claim 1, further comprising means carried by said endless belt for removing paraffin deposits from said well casing.

9. An apparatus for removing oil from a well, comprising:

a loop of roller chain;

a plurality of containers attached to said roller chain;

a sprocket for attachment to a power source, said sprocket adapted to drive a first end of said loop;

a weighted module for carrying a second end of said loop into an oil well; and polymeric shoulders functioning as wear pads on said roller chain for preventing said roller chain from contacting the sides of said oil well.

10. The apparatus of claim 9, further comprising means for preventing said containers from contacting the sides of said oil well.

11. The apparatus of claim 10, further comprising means for preventing said containers from contacting said sprocket.

12. The apparatus of claim 10, wherein said means for preventing said containers from contacting the sides of said oil well are said wear pads.

13. The apparatus of claim 9, further comprising means for shaking said containers to remove oil therefrom.

14. The apparatus of claim 9, wherein said containers are formed of elastomeric material.

15. The apparatus of claim 9, wherein said containers are attached in pairs on opposite sides of said roller chain.

16. An article for use in a cylindrical oil well bore, comprising:

a container having a normally open top opening for filling said container and a normally closed bottom opening that opens and releases the contents of said container when said container is compressed; and a portion of said container conforming to the curvature of the inside of said bore for scraping accumulated material from the inside of said bore.

17. The article of claim 16, further comprising means for attaching said container to a roller chain.

18. The article of claim 16, further comprising means adjacent said top opening for agitating and excavating particulate matter inside said casing.

19. The article of claim 16, further comprising a roller chain attached to said container.

20. A system for enhancing the production of oil from an oil well by evacuating both solids and fluids therefrom, comprising:

means at the head of the well for securing said system;

means attached to said well head means for penetrating said solids while simultaneously evacuating said solids and fluids from said well, thus stimulating the rate of production of said well; and an endless belt extending between said securing means and said penetrating means for transporting said solids and fluids to the well head for collection.

21. The system of claim 20 wherein said endless belt drives said penetrating means through said solids in said well.

22. The system of claim 20 wherein said penetrating means also comprises means for guiding said system down into said well in order to avoid damage to said well.

23. The system of claim 25 wherein said penetrating means comprises a means for drawing itself through said solids.

24. The system of claim 20 wherein said securing means at said well head is transportable.

25. A method, comprising the steps of:

introducing an endless belt into an oil well having a layer of particulate matter therein, said endless belt carrying means to excavate said particulate matter and containers to hold said particulate matter;

excavating said particulate matter with said excavating means and lifting said particulate matter out of said well in said containers by driving said belt in an endless loop;

removing said particulate matter from said containers;

continuing to drive said belt, filling said containers with oil flowing into said well and with particulate matter carried by said oil;

lifting said containers filled with said oil and with said particulate matter out of said well; and removing said oil and said particulate matter from said containers.

26. The method of claim 25, wherein said endless belt is a roller chain.

27. The method of claim 26, wherein said particulate matter is sand and said method further comprises the step of lowering said roller chain deeper into said well as said layer of sand is excavated.

28. The method of claim 25, further comprising the steps of:

introducing a weighted downhole unit into said oil well;

locating said downhole unit substantially inside said endless belt; and reversing said endless belt around said downhole unit while driving said belt.

29. The method of claim 25, wherein said removing steps comprise compressing said containers to remove said oil and said particulate matter through a transverse slit in said containers.

30. A system for enhancing the production of oil from an oil well by evacuating sand, paraffin and other solid matter therefrom, said well having a well bore surrounded by a well casing, the system comprising:

a station located at the well head for receiving and collecting said solids as well as oil produced from said well;

a downhole unit located inside said well casing near the bottom of said well to provide an anchor for said system;

an endless belt at least partially supporting said downhole unit at a predetermined depth in said well, said belt being driven between said station and said downhole unit;

means on said belt for simultaneously evacuating from said well said solids and said oil, thereby enhancing the production of said oil; and means for excavating said solids to facilitate their accumulation and evacuation by said evacuation means.

31. The evacuation system of claim 30 wherein said excavation means is driven by said endless belt.

32. The evacuation system of claim 30 wherein said excavation means is mounted on the leading edge of said downhole unit to provide means for drawing a portion of said evacuation system into said solids, thereby enhancing the evacuation of said solids from the well by means of said evacuation means.

* * * * *